United States Patent [19]

Seager

[11] Patent Number: 4,753,373

[45] Date of Patent: Jun. 28, 1988

[54] POSITIVE DISPLACEMENT DISPENSER

[75] Inventor: Richard H. Seager, Mystic, Conn.

[73] Assignee: Risdon Corporation, Naugatuck, Conn.

[21] Appl. No.: 852,238

[22] Filed: Apr. 15, 1986

[51] Int. Cl.[4] ..... B67D 5/42

[52] U.S. Cl. ..... 222/390; 222/151; 222/391; 222/402.12; 222/509; 222/559

[58] Field of Search ..... 222/390, 391, 402.12, 222/505, 508, 509, 151, 196.2, 196.3, 256, 259, 260, 340, 341, 380, 383, 386, 387, 547, 559–561, 564

[56] References Cited

U.S. PATENT DOCUMENTS

| | | | |
|---|---|---|---|
| 1,468,534 | 9/1923 | Lang | 222/196.2 |
| 1,716,487 | 6/1929 | Davis | 222/256 |
| 1,944,067 | 1/1934 | Collins | 401/175 |
| 2,080,343 | 5/1937 | Smith | 222/390 X |
| 2,789,737 | 4/1957 | Palo | 222/391 X |
| 2,816,309 | 12/1957 | Worth et al. | 222/151 X |
| 3,027,052 | 3/1962 | Marraffino | 222/390 X |
| 3,211,347 | 10/1965 | Phillips, Jr. | 222/386 X |
| 3,563,414 | 2/1971 | Coulombe et al. | 222/386 X |
| 3,687,339 | 8/1972 | Dessureault | 222/391 X |
| 3,728,035 | 4/1973 | Reitknecht | 401/175 |
| 3,753,516 | 8/1973 | Crider | 222/95 |
| 3,756,730 | 9/1973 | Spatz | 222/390 X |
| 3,774,816 | 11/1973 | Bratton | 222/145 |
| 3,853,243 | 12/1974 | Forman | 222/102 X |
| 3,885,707 | 5/1975 | Wittwer | 222/96 |
| 3,993,226 | 11/1976 | Pavenick | 222/390 X |
| 4,019,655 | 4/1977 | Moeller | 222/101 X |
| 4,139,127 | 2/1979 | Gentile | 222/390 |
| 4,144,988 | 3/1979 | Bergman | 222/390 |
| 4,145,147 | 3/1979 | Schuck | 401/175 |
| 4,189,065 | 2/1980 | Herold | 222/390 X |
| 4,303,110 | 12/1981 | Chen | 222/71 X |
| 4,369,901 | 1/1983 | Hidding | 222/151 X |
| 4,418,840 | 12/1983 | Gardner, Sr. | 222/102 X |
| 4,424,916 | 1/1984 | Pearson | 222/94 X |
| 4,437,584 | 3/1984 | Connors et al. | 222/391 X |
| 4,437,591 | 3/1984 | von Schuckmann | 222/391 |
| 4,457,641 | 7/1984 | Smith | 222/390 X |
| 4,479,592 | 10/1984 | Rusing et al. | 222/391 X |
| 4,485,943 | 12/1984 | Czech | 222/256 |
| 4,508,239 | 4/1985 | Rozzen | 222/96 X |
| 4,508,240 | 4/1985 | Arango | 222/96 |
| 4,511,068 | 4/1985 | Bossina | 222/340 X |
| 4,515,293 | 5/1985 | Hill et al. | 222/95 |
| 4,538,747 | 9/1985 | von Schuckmann | 222/260 |
| 4,564,130 | 1/1986 | Evlenburg | 222/383 X |
| 4,598,843 | 7/1986 | Foster et al. | 222/387 X |
| 4,629,097 | 12/1986 | Moore | 222/386 X |

FOREIGN PATENT DOCUMENTS

| | | | |
|---|---|---|---|
| 0140104 | 9/1984 | European Pat. Off. . | |
| 3104726 | 8/1982 | Fed. Rep. of Germany | 222/386 |
| 295822 | 4/1932 | Italy | 222/390 |
| 8302103 | 6/1983 | PCT Int'l Appl. . | |
| 221715 | 12/1923 | United Kingdom . | |
| 231874 | 4/1924 | United Kingdom . | |
| 264832 | 1/1926 | United Kingdom . | |
| 283644 | 1/1928 | United Kingdom . | |
| 332300 | 4/1929 | United Kingdom . | |
| 432539 | 10/1933 | United Kingdom . | |
| 401003 | 11/1933 | United Kingdom . | |
| 2049062 | 12/1980 | United Kingdom . | |
| 2064012 | 6/1981 | United Kingdom . | |
| 2079379 | 1/1982 | United Kingdom . | |
| 2146612 | 4/1985 | United Kingdom . | |

*Primary Examiner*—Joseph J. Rolla
*Assistant Examiner*—Kevin P. Shaver
*Attorney, Agent, or Firm*—St. Onge Steward Johnston & Reens

[57] ABSTRACT

The present invention is a positive displacement dispenser which is particularly useful in dispensing viscous materials such as toothpaste. This dispenser has a longitudinally-extending housing which defines a chamber for material to be dispensed, a discharge orifice in the housing through which the material is dispensed from the chamber, a threaded rod having an axis extending through the chamber, a piston with a threaded opening mounted on the rod so that rotation of the rod moves the piston, an actuating lever pivotally mounted to the housing, and a rotatable wheel operatively coupling the threaded rod and the actuating lever so that depression of the actuating lever causes the wheel to turn the threaded rod and advance the piston. The rotatable wheel is coaxially-mounted to the threaded rod and has a plurality of pins mounted on a circular path surrounding the axis of the wheel. A drive bar is attached to the actuating lever such that depression of the lever causes the drive bar to engage one of the pins and rotate the wheel a fixed amount. A return spring which is also attached to the actuating lever returns the actuating lever to its original position and simultaneously urges the drive bar against an adjacent pin.

38 Claims, 2 Drawing Sheets

POSITIVE DISPLACEMENT DISPENSER

BACKGROUND OF THE INVENTION

For many years, packaging engineers have sought to develop an easy to use dispenser for viscous materials like toothpaste. The most common way to package such material is in flexible tubes with thin metallic walls which are squeezed to dispense toothpaste from the tube. Problems, however, arise with such dispensers when substantially all the toothpaste in the tube has been used. The consumer is then faced with either wasting the residual toothpaste by throwing out the tube or struggling to squeeze a portion of that residue onto his toothbrush.

One solution to this problem is to use a compression device to squeeze more of the residual toothpaste from conventional toothpaste tubes. As illustrated by U.S. Pat. No. 3,853,243 to Forman, U.S. Pat. No. 4,019,655 to Moeller, U.S. Pat. No. 4,418,840 to Gardener, U.S. Pat. No. 4,508,240 to Arango, and U.S. Pat. No. 4,515,293 to Hill et al., these compression devices utilize rollers, belts, or fluid pressure to advance toothpaste in the tube toward the tube's discharge opening. Such devices, however, tend to leave toothpaste in the tube, have complicated compression mechanisms, and occupy extra space in the bathroom.

As an alternative to toothpaste tubes, stationary toothpaste dispenser housings have been developed in which toothpaste is discharged from a chamber within the dispenser by means of fluid pressure or a pump. Examples of such toothpaste dispensers are illustrated by U.S. Pat. No. 3,753,516 to Crider, U.S. Pat. No. 3,885,707 to Wittwer, U.S. Pat. No. 4,303,110 to Chen, U.S. Pat. No. 4,424,916 to Pearson, and U.S. Pat. No. 4,508,239 to Rozzen. These dispensing devices, however, are somewhat complex and bulky.

Another alternative to conventional toothpaste tubes is a toothbrush attached to chambers for storing and dispensing toothpaste, as illustrated by U.S. Pat. No. 1,944,067 to Collins, U.S. Pat. No. 3,728,035 to Reitknecht, U.S. Pat. No. 4,145,147 to Schuck, and U.S. Pat. No. 4,457,641 to Smith. These devices also have problems of complexity, weight when filled with toothpaste, and bulk compared with conventional toothbrushes.

Another toothpaste dispenser is disclosed by U.S. Pat. No. 3,563,414 to Coulombe which comprises a container with a spatula attached to a rotatable cover, whereby rotation of the cover causes the toothpaste to be ejected from the container through a discharge opening.

U.S. Pat. No. 3,993,226 to Pavenick discloses a piston-type toothpaste dispenser which travels on a threaded rod to force toothpaste through an outlet. Rotation of the threaded rod is imparted by depression of a longitudinally reciprocating operating means which acts on a kinematic translating means to turn the rod. The structure of this dispenser has many component parts arranged in a complicated manner such that it is expensive to commercialize.

Other piston-type dispensers are disclosed by U.S. Pat. No. 1,716,487 to Davis, U.S. Pat. No. 2,789,737 to Palo, U.S. Pat. No. 3,027,052 to Marraffino, U.S. Pat. No. 3,756,730 to Spatz, U.S. Pat. No. 3,774,816 to Bratton, U.S. Pat. No. 4,139,127 to Gentile, U.S. Pat. No. 4,144,988 to Bergman, U.S. Pat. No. 4,189,065 to Herold, G.B. Pat. No. 221,715 to Watson, G.B. Pat. No. 231,874 to Julliard, G.B. Pat. No. 264,832 to Billeter et al., G.B. Pat. No. 283,644 to White, G.B. Pat. No. 401,003 to Voelk, G.B. Pat. No. 332,300 to Bramson, WO 83/02103 to Morel et al., and G.B. Pat. No. 2,079,379 to Planas.

Another type of toothpaste dispenser which has become especially popular recently is the pump-type toothpaste dispenser.

U.S. Pat. No. 4,437,584 to Connors et al. ("Connors"), U.S. Pat. No. 4,437,591 to von Shuckmann ("von Shuckmann"), and U.S. Pat. No. 4,479,592 to Rusing et al ("Rusing") illustrate one pump-type dispenser model in which toothpaste within a housing is dispensed by advancing a piston on an unthreaded rod within the housing toward a dispensing outlet. In the Connors and von Shuckmann dispensers, the piston is advanced by pushing the rod axially downward and then releasing pressure from the rod which returns to its original position. The piston remains stationary during downward movement of the rod by gripping the dispenser's inner wall. The piston then travels upwardly with the rod when pressure is released. In Rusing's dispenser, the piston is advanced by pushing a cylinder within the dispenser housing downwardly and then releasing pressure on the cylinder. The piston remains stationary during downward movement of the cylinder by gripping the rod and then moves upwardly when pressure is released by gripping the cylinder. The operation of all these devices depends on the gripping of component parts covered with toothpaste. As a result, slippage may occur which either lessens the quantity of toothpaste dispensed by each actuation or precludes the dispensing of any toothpaste at all. Operation of these dispensers is further hampered when toothpaste solidifies adjacent the gripping surfaces of the piston.

Another pump-type toothpaste dispenser is illustrated by G.B. Pat. No. 432,539 to Billing, G.B. Pat. No. 2,049,062 to Wippermann, G.B. Pat. No. 2,064,012 to Lorscheid, and G.B. Pat. No. 2,146,612 to Snedker. These dispensers are all provided with a piston which is mounted on a threaded rod and is advanced within the dispenser. The dispensers of Billing, Lorscheid, Wippermann, and Snedker all require a large number of complicated parts which would tend to make assembly of these dispensers more expensive. As to Snedker, it is also difficult to dispense a relatively constant amount of toothpaste, because dispensing is dependent on the amount of pressure applied to the cap which has a highly variable extent of movement.

SUMMARY OF THE INVENTION

The present invention is drawn to a positive displacement dispenser for viscous material like toothpaste. The dispenser comprises a longitudinally-extending housing which defines a first chamber for storing material to be dispensed through a discharge orifice in the housing and a second chamber. The first chamber is provided with a threaded rod having a longitudinally-extending axis upon which a piston with a threaded central opening is mounted such that rotation of the rod advances the piston. An actuating lever is mounted to the housing and pivots within the second chamber about an axis perpendicular to the axis of the threaded rod. A transmission means within the second chamber operatively couples the actuating lever and the threaded rod such that depression of the actuating lever turns the threaded rod and advances the piston. The transmission means comprises a rotatable wheel coaxially-mounted to the threaded rod with a plurality of pins mounted on a circular path surrounding the axis of the wheel. A drive bar is attached to the actuating lever in a position where depression of the actuating lever causes the drive bar to push one of the pins which rotates the wheel and threaded rod and advances the piston a fixed amount. A return spring is also attached to the actuating lever to return the actuating lever to its original position following depression and to move the drive bar against an adjacent pin for subsequent dispensing of material. The drive bar, return spring, and actuating lever are all integrally formed from plastic.

A one-way ratchet device is provided in conjunction with the wheel to prevent the wheel and the threaded rod from rotating in a direction which would retract the piston away from the discharge opening.

The housing is provided with a wall to separate the first and second chambers so that toothpaste does not foul the wheel, actuating lever, drive bar, or return spring. The wall has a snap ring extending into the first chamber, while the threaded rod has a detent ring engageable with the snap ring to prevent axial movement of the rod and to seal the second chamber from toothpaste in the first chamber.

The dispenser of the present invention further includes a closure means covering the discharge opening when material is not being dispensed from the first chamber. The closure means includes a cutter to slice material being dispensed and a discharge bar which extends into the discharge tube connecting the first chamber and the discharge orifice. The discharge bar breaks up solidified material within the discharge tube during depression and release of the actuating lever and scrapes the portion of the discharge tube adjacent the second chamber to prevent material being dispensed from entering the second chamber. The discharge bar has a redirecting surface to dispense material in the first chamber at a 90° angle to the dispenser housing. The discharge bar and actuating lever are all integrally formed from plastic and connected together with a living hinge.

The piston utilized by the dispenser of the present invention has a first wiping surface extending from the piston toward the discharge orifice to wipe the walls of the housing defining the first chamber. In addition, the piston has a trough adjacent the first wiping surface to permit radially-inward movement of the first wiping surface as the piston moves along the converging walls of the housing which converge toward the discharge opening. Further wiping of these walls by the piston is achieved by a second wiping surface farther from the discharge orifice than the first wiping surface.

The present invention has numerous advantages over prior art toothpaste dispensers.

By virtue of the positive displacement mechanism utilized in the present invention, each time the actuating lever is depressed, the wheel rotates, the rod turns, and the piston advances without slippage. As a result, a constant amount of toothpaste is dispensed upon a toothbrush during each actuation of the dispenser until substantially all the toothpaste in the dispenser is utilized. Toothpaste is dispensed at 90° to the housing and precisely cut by a cutter associated with the actuating lever.

The simple construction of the present invention makes it inexpensive and easy to manufacture. The dispenser can be produced from plastics, such as polypropylene or other polyolefins, by injection molding of only four parts. One piece is the housing, another piece is the piston, the wheel and the threaded rod are another piece, and the actuating lever, drive bar, and return spring are another piece. If a cap is utilized, this additional piece can also be produced by injection molding. These pieces are easily snapped together to provide a compact construction within a single housing.

The actuating lever and transmission means are isolated from toothpaste in the dispenser by the wall separating the first and second chambers, a wall separating the discharge tube from the second chamber, and the discharge bar which bears against the wall separating the discharge tube and the second chamber to prevent toothpaste from fouling the actuating lever, wheel, drive bar, and return spring. The threaded rod and the piston are the only moving parts which contact toothpaste; however, these components will not slip as a result of such contact because they are threaded.

DETAILED DESCRIPTION OF THE DRAWINGS

Figure 1:
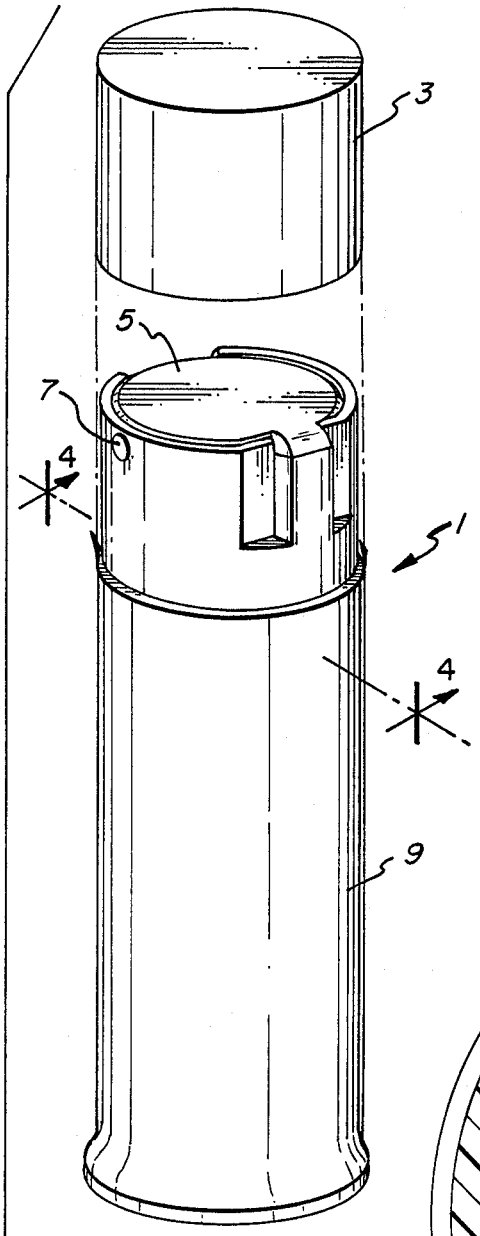
FIG. 1 is a perspective front view of a dispenser according to the present invention in a non-actuated operating mode.

FIG. 1 is a perspective front view of a dispenser according to the present invention in a non-actuated operating mode. The dispenser includes a housing 1 comprising a base 9 and a dispensing head 11. Actuating lever 5 is mounted to dispensing head 11 at the lever's pivot arm 7. A cap 3 may be optionally fitted over the dispensing head 11 and against base 9 to give the dispenser a uniform outer appearance. The outer surfaces of housing 1 have a one degree upward taper so that the outer diameter of the housing is greater at the bottom than at the top.

Figure 2:
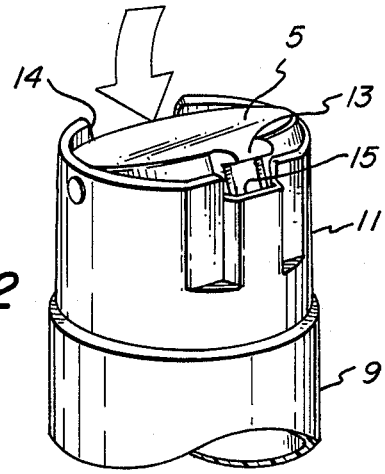
FIG. 2 is a perspective front view of the upper portion of a dispenser according to the present invention in an actuated operating mode.

FIG. 2 shows a perspective front view of the upper portion of a dispenser according to the present invention in an actuated operating mode. When the back of actuating lever 5 is depressed, as shown by the arrow in FIG. 2, the lever pivots about its pivot arm 7 so that discharge orifice 15 in dispensing head 11 is uncovered. Discharge orifice 15 is normally covered by closure 13 which is integrally-formed with actuating lever 5. Depression of actuating lever 5 raises closure 13 so that toothpaste can be dispensed from discharge orifice 15, while release of actuating lever 5 causes closure 13 to drop back over discharge orifice 15.

Figure 3:
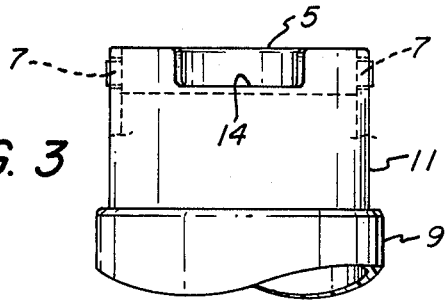
FIG. 3 is a perspective rear view of a dispenser according to the present invention in an unactuated mode.

FIG. 3 is a perspective rear view of the upper portion of a dispenser according to the present invention in an unactuated mode. As FIGS. 2 and 3 illustrate, a portion of housing 1's dispensing head 11 is cut away at cutout surface 14 to expose the side surface of actuating lever 5.

Figure 4:
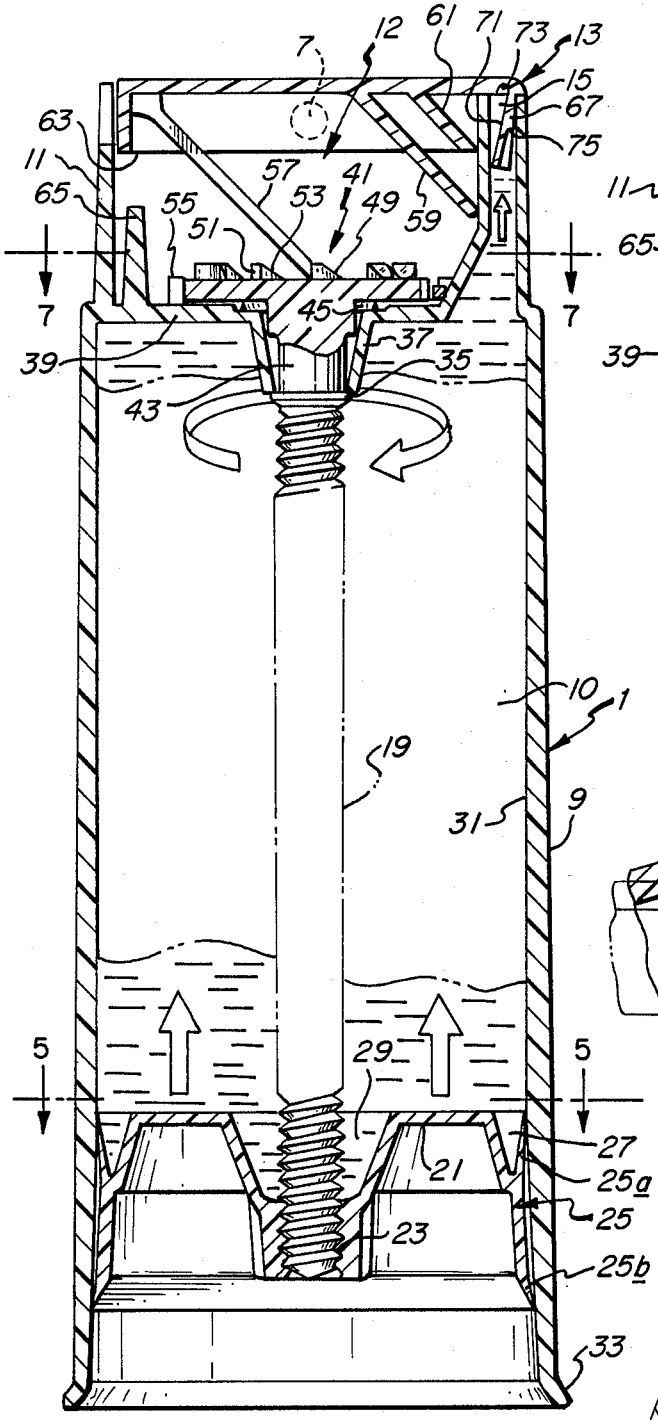
FIG. 4 is a side cross-sectional view of a dispenser according to the present invention taken along line 4—4 of FIG. 1.

FIG. 4 is a side cross-sectional view of a dispenser according to the present invention taken along line 4—4 of FIG. 1. As this figure illustrates, the walls of base 9 define a hollow toothpaste chamber 10. Toothpaste in toothpaste chamber 10 is forced upwardly through discharge tube 17 (as shown by the arrow therein) and discharge orifice 15 by upward movement of piston 21 (as shown by the arrows above the piston) from an initial position adjacent bottom 33. The piston is driven upwardly by clockwise rotation of threaded rod 19 (as shown by the arrow around the rod) on which piston 21 is mounted by means of threaded opening 23. The outer periphery of the piston is provided with a wiper 25 having an upper wiping surface 25*a* and a lower wiping surface 25*b*. A wiper trough 27 is provided adjacent upper wiping surface 25*a* so that upper wiping surface 25*a* can be urged radially inwardly as piston 21 moves upwardly through toothpaste chamber 10. Such radially inward movement is needed, because the interior walls 31 of base 9 which define toothpaste chamber 10 converge upwardly at a one degree angle whereby the inner diameter of the top of the toothpaste chamber is greater than that of the bottom. Piston 21 is also provided with a screw cup 29 above threaded opening 23 and surrounding threaded rod 19.

Figure 5:
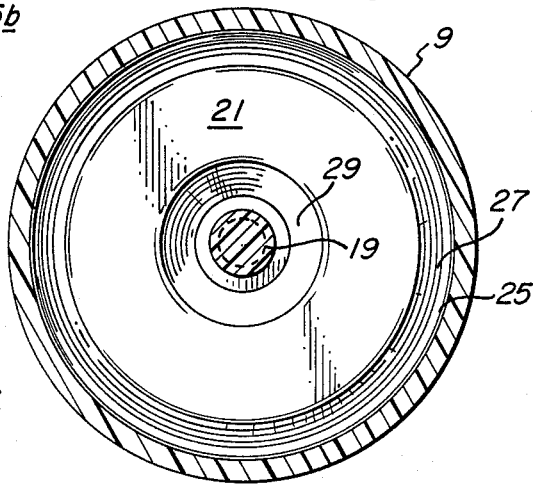
FIG. 5 is a top cross sectional view of a dispenser in accordance with the present invention taken along line 5—5 of FIG. 4.

As shown in FIG. 5 which is a top cross sectional view of a dispenser in accordance with the present invention taken along line 5—5 of FIG. 4, piston 21, upper wiping surface 25*a*, wiper trough 27, and screw cup 29 are generally circular.

Returning to FIG. 4, it is apparent that the upper portion of threaded rod 19 is provided with a detent ring 35 which engages with a snap ring 37 extending from upper wall 39. Engagement of detent ring 35 and snap ring 37 prevents threaded rod 19 from moving axially upward and seals drive chamber 12 from the material in toothpaste chamber 10. Upper wall 39 divides toothpaste chamber 10 and drive chamber 12 so that toothpaste does not foul the dispenser parts in drive chamber 12. Above detent ring 35 is a drive shaft 43 which connects threaded rod 19 to rotary drive 41. Rotary drive 41 rests on upper surface of wall 39 by means of drive base 45.

Figure 7:
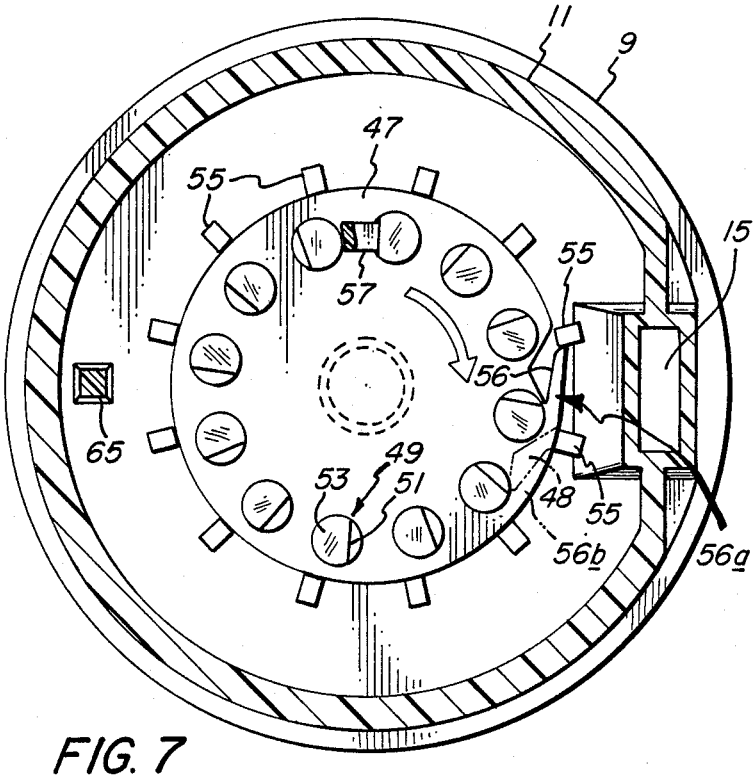
FIG. 7 is a top cross sectional view of a dispenser in accordance with the present invention taken along line 7—7 of FIG. 4.
Figure 6:
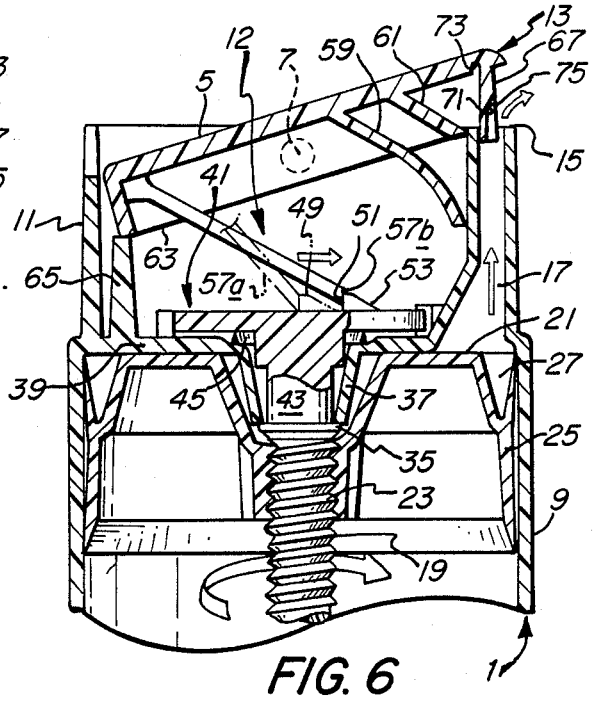
FIG. 6 is a side cross-sectional view of the upper portion of a dispenser according to the present invention in an actuated operating mode with the piston fully advanced.

As shown in FIGS. 4, 6 (which is a side cross-sectional view of the upper portion of a dispenser according to the present invention in an actuated operating mode with the piston fully advanced), and 7 (which is a top cross sectional view of a dispenser in accordance with the present invention taken along line 7—7 of FIG. 4), rotary drive 41 includes a wheel 47 on which are mounted a plurality of pins 49 position along a circular path surrounding the axis of the wheel 47. Each of the pins are provided with a flat face 51 and a sloped face 53. Clockwise rotation of wheel 47 and threaded shaft 19, as shown by the arrows in FIGS. 6 and 7, is imparted by urging drive bar 57 against the flat face 51 of one of the pins 49 on wheel 47. As shown in more detail in FIG. 6, drive bar 57 is in a first angled position 57*a* relative to wheel 47 prior to depression of actuating lever 5 and moves to a second angled position 57*b* relative to wheel 47 upon depression of actuating lever 5. In both of these positions, drive bar 57 remains relatively straight. The angle of drive bar 57 relative to wheel 47 at first position 57*a* is greater than it is at second position 57*b*. Such actuation causes movement of the pin 49 against which drive bar 57 is engaged from left to right as shown by the arrow in drive chamber 12 of FIG. 6 and clockwise as shown by the arrow in FIG. 7. Upon each depression of actuating lever 5, the distance drive bar 57 moves from first position 57*a* to second position 57*b*, the extent of rotation by wheel 47 and threaded rod 19, and the amount of advancement by piston 21 within toothpaste chamber 10 are all constant. This ensures that a predetermined quantity of toothpaste is always dispensed by each depression of actuating lever 5.

Figure 8:
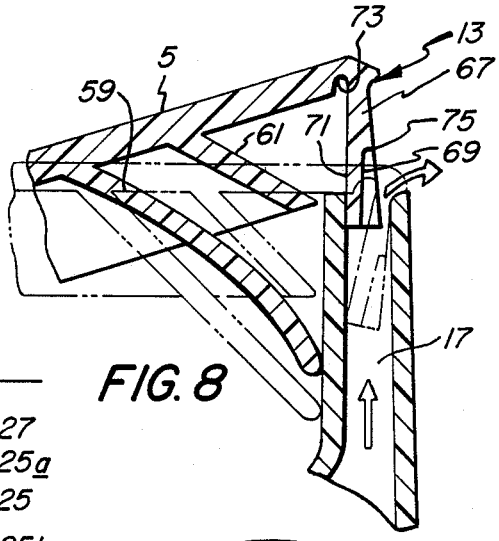
FIG. 8 is a side cross-sectional view of the discharge mechanism and part of the actuating mechanism of a dispenser in accordance with the present invention showing an actuated operating mode in solid lines and a non-actuated operating mode in dotted lines.

After drive bar 57 is moved to second position 57*b* and movement of base 63 of actuating lever 5 is halted by standing vane 65, actuating lever 5 is released and drive bar 57 slides over sloped face 53 of the counterclockwisely adjacent pin 49 and returns to first position 57*a* where it engages a flat face 51 of that same counterclockwisely adjacent pin 49. Actuating lever 5 is returned to its original position and drive bar 57 is returned to first position 57*a* by means of return spring 59 attached to actuating lever 5. As shown in FIGS. 4, 6, and 8 (which is a side cross-sectional view of the discharge mechanism and part of the actuating mechanism of a dispenser in accordance with the present invention showing an actuated operating mode in solid lines and a non-actuated operating mode in dotted lines), return spring 59 is straight when actuating lever 5 is in its undepressed position but then bends against the wall of discharge tube 17 when actuating lever 5 is depressed. The bend in return spring 59 causes it to push off against the wall of discharge tube 17 when actuating lever 5 is released such that actuating lever 5 returns to its original, undepressed position, drive bar 57 returns to first position 57*a*, and return spring 59 straightens. During depression of actuating lever 5, its slanted wall 61 moves along the wall of discharge tube 17.

As shown in FIG. 7, counterclockwise rotation of wheel 47 is prevented by one of a plurality of ratchet dogs 55 positioned around the circumference of wheel 47 and engageable with tooth 56 in the periphery of wheel 47. Upon the exertion of pressure by drive bar 57 against the flat face 51 of a pin 49, tooth 56 peninsular tooth 56 which is connected to the circumference of wheel 47 but spaced from radially inward portions of wheel 47 by cutout 48, in its first position 56*a* (defined by solid lines), is urged radially inwardly by the ratchet dog 55' located before first position 56*a* in a clockwise direction to permit wheel 47 to move in the clockwise direction. After tooth 56 moves past this ratchet dog 55' into second position 56*b* (defined by dotted lines), the tooth moves radially outwardly such that this dog engages the counterclockwisely most extreme portion of tooth 56 to prevent counterclockwise rotation of wheel 47. Ratchet dogs 55 are spaced around wheel 47 such that a dog will always engage the counterclockwisely most extreme portion of tooth 56 when drive bar 57 reaches second position 57*b*, thereby locking wheel 47 against counterclockwise rotation when depression of actuating bar 5 and left to right movement of drive bar 57 (as shown in FIG. 6) is completed.

As shown in FIGS. 4, 6, and 8, a discharge bar 67 extends downwardly from the actuating lever 5 and closure 13 into discharge tube 17. Discharge bar 67, closure 13, and actuating lever 5 are integrally molded from a plastic such as polypropylene and joined at living hinge 73. Discharge bar 67 is provided with a redirecting surface 69 which, as shown by the arrow from discharge orifice 15 in FIGS. 6 and 8, permits toothpaste to be directed at a 90-degree angle to housing 1. When actuator 5 is released, closure 13 drops over discharge orifice 15 and cutter 75 cuts the dispensed toothpaste. Living hinge 73 permits the bending of discharge bar 67 so that its wiping surface 71 is biased against the wall of discharge tube 17 closest to drive chamber 12. Such bias precludes toothpaste from getting behind discharge bar 67 and fouling the parts of drive chamber 12 with toothpaste. In addition, the depression or release of actuating lever 5 causes discharge bar 67 to break up any solidified toothpaste in discharge tube 17.

As previously noted, the component parts of the present invention are easily manufactured by injection molding a polyolefin such as polypropylene. Such molding can be effected by forming 4 or 5 pieces depending on whether a cap 3 is utilized. One piece is housing 1 complete with discharge tube 17, upper wall 39, standing vane 65, snap ring 37 and ratchet dogs 55. Another piece is actuating lever 5 complete with drive bar 57, return spring 59, closure 13, pivot arms 7, and discharge bar 67. A third piece is piston 21 including wiper 25, wiper trough 27, threaded opening 23, and screw cup 29. The fourth piece is the combination of threaded rod 19, detent ring 35, drive shaft 43, drive base 45, wheel 47, pins 49, and tooth 56.

Once the pieces of the present invention are formed by injection molding, they can be easily assembled. First, the end of threaded screw 19 distal from wheel 47 is pushed into toothpaste chamber 10 through snap ring 37 until the detent ring 35 is below snap ring 37 at which point snap ring 37 locks the detent ring 35, preventing axial upward movement of threaded rod 19 and sealing drive chamber 12. Actuating lever 5 can then be snapped into dispensing head 11 of housing 1 at the lever's pivot arms 7 which are molded in the actuating lever. Toothpaste chamber 10 is then filled with toothpaste to a predetermined point, and piston 21 is inserted through bottom 33 of housing 1 and rotated so that threaded opening 23 is coupled to threaded rod 19.

In its assembled form, the present invention can dispense viscous material, such as toothpaste, by depression of actuating lever 5 until actuating lever base 63 abuts standing vane 65. Such depression of actuating lever 5 urges drive bar 57 against flat face 51 of pin 49 so that drive bar 57 and the pin 49 it engages move in a clockwise direction from first position **57*a* to second position 57*b*. Such movement causes wheel 47 and threaded rod 19 to rotate in a clockwise direction which advances piston 21 upwardly toward discharge orifice 15. The distance between actuating lever base 63 and standing vane 65, the length of drive bar 57, the distance between adjacent pins 49, and the slope of the threads of threaded rod 19 and piston 21 are designed to permit a fixed and predetermined quantity of toothpaste to be dispensed through discharge orifice 15. Toothpaste can continue to be dispensed until piston 21 moves upwardly to the extent that it abuts upper wall 39. Occurring simultaneously with depression of actuator 5 is the raising of closure 13 away from discharge orifice 15 so that material urged upwardly by piston 21 can be dispensed. Redirecting surface 69 in discharge bar 67 turns the dispensed toothpaste 90 degrees from its travel within discharge tube 17 so that it will land on a toothbrush with the tips of its bristles extending upwardly adjacent discharge orifice 15**.

Upon release of actuating lever 5, return spring 59 urges actuating lever 5 to its undepressed position and drive bar 57 from second position **57*b* over the sloped face 53 of the counterclockwisely adjacent pin 49 to first position 57*a* against the flat face 51 of the counterclockwisely adjacent pin 49. The movement of actuating lever 5 to its original position drops closure 13 onto discharge orifice 15 such that cutter 75 slices the toothpaste being dispensed. Counterclockwise rotation of wheel 47 during the return movement of actuating lever 5 and drive bar 57 by return spring 59 is prevented by the engagement of one of the ratchet dogs 55 with tooth 56 when drive bar 57 reaches second position 57*b***.

Although the invention has been described for the purpose of illustration, it is understood that such detail is solely for that purpose and variations can be made therein by those skilled in the art without departing from the spirit and scope of the invention.

What is claimed:

1. A dispenser comprising:

a longitudinally-extending housing having surfaces defining a first chamber in which material to be dispensed is stored and a second chamber;

a discharge orifice in said housing through which material in the first chamber is dispensed;

a threaded rod having an axis extending longitudinally through the first chamber;

a piston mounted on said threaded rod by means of a threaded opening through said piston;

an actuating lever mounted to said housing and non-linearly movable within the second chamber; and transmission means operatively coupling said threaded rod and said actuating lever, said transmission means comprising:

a rotatable portion connected to said threaded rod and a drive bar attached to said actuating lever and engageable with the rotatable portion, wherein the non-linear movement of said actuating lever within the second chamber between depressed and undepressed positions urges the drive bar against the rotatable portion, causing the rotatable portion and said threaded rod to turn in one direction to advance said piston within the first chamber toward said discharge opening, and wherein the drive bar remains relatively straight regardless of whether said actuating lever is in its depressed or undepressed position.

2. A dispenser according to claim 1, wherein said actuating lever and said discharge orifice are at one end of said housing.

3. A dispenser according to claim 1 further comprising:

a cap attached to said housing over said actuating lever.

4. A dispenser according to claim 1, further comprising:

a return spring attached to said actuating lever to return said actuating lever to a starting position when said actuating lever is released after depression.

5. A dispenser according to claim 4, wherein said drive bar, said return spring, and said actuating lever are made of integrally-formed polymeric material.

6. A dispenser according to claim 1, wherein said piston comprises:

a first wiping surface extending from said piston toward said discharge orifice to wipe material being dispensed from the surfaces of said housing defining the first chamber.

7. A dispenser according to claim 6, wherein the surfaces of said housing defining the first chamber converge toward said discharge orifice and wherein said piston has a trough adjacent the first wiping surface to permit radially-inward movement of the first wiping surface as said piston moves toward said discharge orifice.

8. A dispenser according to claim 7, wherein said piston further comprises:

a second wiping surface farther from said discharge orifice than the first wiping surface.

9. A dispenser according to claim 1 further comprising:

a wall dividing the first and second chambers of said housing.

10. A dispenser according to claim 9 further comprising:

a standing vane attached to said wall to restrict the extent said actuating lever is depressed.

11. A dispenser according to claim 9, wherein said transmission means is in the second chamber of said housing.

12. A dispenser according to claim 11, wherein the rotatable portion of said transmission means comprises a rotatable wheel coaxially-mounted to said threaded rod, whereby rotation of said wheel turns said threaded rod and advances said piston.

13. A dispenser according to claim 12, wherein the rotatable portion further comprises:

a plurality of pins, extending upwardly from the topmost portion of said rotatable wheel and being mounted on the wheel along a circular path surrounding the axis of the wheel, said pins each having a flat surface perpendicular to the wheel and a sloped surface, whereby said drive bar engages the flat surface of the pin during depression of said actuating lever to rotate the wheel and said threaded rod and to advance said piston a fixed amount whereby said return spring urges said drive bar over the sloped surface and against the flat surface of an adjacent pin when said actuating lever is released.

14. A dispenser according to claim 12, wherein said dispenser is made from four molded polymeric pieces, wherein said housing is one piece, said piston is another piece, said wheel and said threaded rod are another piece, and said actuating lever and said drive bar are another piece 15. A dispenser according to claim 12 further comprising:

one-way means to prevent the wheel and said threaded rod from rotating in a direction which will retract said piston away from said discharge orifice.

16. A dispenser according to claim 15, wherein said one-way means comprises:

a peninsular tooth connected to said wheel along its circumference but spaced from radially inward portions of said wheel by a cutout extending inwardly from the circumference of said wheel; and a plurality of fixed ratchet dogs attached to said wall and surrounding the wheel, whereby one of the ratchet dogs will urge the tooth radially inwardly toward the cutout upon depression of said actuating lever and will engage the tooth after said actuating lever is fully depressed to prevent rotation of the wheel in a direction which will retract said piston.

17. A dispenser according to claim 9, wherein said wall has a snap ring extending into the first chamber and said threaded rod has a detent ring engageable with the snap ring to prevent axial movement of said threaded rod and to seal the second chamber.

18. A dispenser according to claim 17 further comprising:

a discharge tube defining a passage connecting the first chamber and said discharge orifice.

19. A dispenser according to claim 18, wherein said discharge tube and said wall are connected.

20. A dispenser according to claim 18 further comprising:

closure means to cover said discharge orifice when material is not being dispensed from the first chamber.

21. A dispenser according to claim 20, wherein the closure means comprises:

a cutter moveable relative to said discharge orifice to effect slicing of the material being dispensed.

22. A dispenser according to claim 20, wherein the closure means comprises:

a discharge bar extending into the passage defined by said discharge tube to break up solidified material when said actuating lever is depressed and released.

23. A dispenser according to claim 22, wherein the discharge bar has a redirecting surface to dispense the material in the first chamber at substantially a 90° angle to said housing when said closure means is not covering said discharge orifice.

24. A dispenser according to claim 22, wherein the discharge bar and said actuating lever are integrally formed from polymeric material and connected together with a living hinge.

25. A dispenser according to claim 24, wherein the living hinge urges the discharge bar to scrape against said discharge tube adjacent the second chamber to prevent material being dispensed from entering the second chamber.

26. A dispenser comprising:

a longitudinally-extending housing having a chamber in which material to be dispensed is stored;

a discharge orifice in said housing through which material in the chamber is dispensed;

means to advance material in the chamber of said housing toward said discharge orifice;

closure means positioned to cover said discharge orifice when material is not being dispensed from the chamber and to move away from said discharge orifice when material is being dispensed;

a discharge bar extending into the passage defined by said discharge tube from said closure means wherein said discharge bar has a redirecting surface to dispense material in the chamber at substantiallly a 90° angle to said housing when said closure means is not covering said discharge orifice; and an actuating lever for operating said means to advance, wherein said discharge bar and said actuating lever are integrally formed from and connected together with a living hinge, whereby depression and release of said actuating lever breaks up solidified material.

27. A dispenser according to claim 26, wherein said closure means comprises:

a cutter to slice the material being dispensed from the chamber.

28. A dispenser according to claim 26 further comprising:

a discharge tube connecting the chamber and said discharge orifice, wherein said discharge tube is scraped and solidified material in said discharge tube broken up by said discharge bar when said closure means is opened and closed.

29. A dispenser comprising:

a longitudinally-extending housing having surfaces defining a chamber in which material to be dispensed is stored;

a discharge orifice in said housing through which material in the chamber is dispensed;

a threaded rod having an axis extending longitudinally through the chamber;

a piston mounted on said threaded rod by means of a threaded opening through the piston;

an actuating lever mounted to said housing for pivotal movement from an undepressed position to a depressed position and back;

a driven element associated with said threaded rod; and a drive bar attached to said actuating lever and engageable with said driven element at an angle, said drive bar remaining relatively straight regardless of whether said actuating lever is in the depressed position or the undepressed position, whereby depression of said actuating lever reduces the angle between said drive bar and said driven element and pushes said drive bar against said driven element to rotate said threaded rod and advance said piston toward said discharge orifice.

30. A dispenser according to claim 29, further comprising:

a return spring attached to said actuating lever to return said actuating lever to a starting position when said actuating lever is released after depression.

31. A dispenser according to claim 30, wherein said drive bar, said return spring, and said actuating lever are integrally-formed polymeric material.

32. A dispenser comprising:

a longitudinally-extending housing having surfaces defining a chamber in which material to be dispensed is stored;

a discharge orifice in said housing through which material in the chamber is dispensed;

a threaded rod having an axis extending longitudinally through the chamber;

a piston mounted on said threaded rod by means of a threaded opening through said piston;

an actuating lever mounted to said housing for pivotal movement from an undepressed position to a depressed position and back;

a rotatable wheel coaxially-mounted to said threaded rod, said wheel having a plurality of pins, extending upwardly from the topmost portion of said rotatable wheel and being mounted on a circular path surrounding the axis of said wheel; and a coupling means between said actuating lever and the pins of said wheel, said coupling means remaining relatively straight regardless of whether said actuating lever is in the depressed position or the undepressed position, whereby depression of said actuating lever pushes said coupling means against the pins, causing said wheel to rotate which turns said threaded rod, thereby advancing said piston toward said discharge orifice.

33. A dispenser according to claim 32 further comprising:

one-way means to prevent the wheel and said threaded rod from rotating in a direction which will retract said piston away from said discharge orifice.

34. A dispenser according to claim 33, wherein said one-way means comprises:

a peninsular tooth connected to said wheel along its circumference but spaced from radially inward portions of said wheel by a cutout extending inwardly from the circumference of said wheel; and a plurality of fixed ratchet dogs surrounding the wheel, whereby one of the dogs will urge the tooth radially inwardly toward the cutout upon depression of said actuating lever and will engage the tooth after said actuating lever is fully depressed to prevent rotation of the wheel in a direction which will retract said piston.

35. A dispenser according to claim 32, wherein said coupling is a drive bar attached to said actuating lever and engageable with the pins of said wheel.

36. A dispenser according to claim 35 further comprising:

a return spring attached to said actuating lever to return said actuating lever and the drive bar to a starting position when said actuating lever is released after depression.

37. A dispenser according to claim 36, wherein the drive bar, said return spring, and said actuating lever are an integrally-formed polymeric material.

38. A dispenser according to claim 36, wherein the pins have a flat surface perpendicular to the wheel and a sloped surface, whereby the drive bar engages the flat surface of one of the pins during depression of said actuating lever to rotate the wheel and said threaded rod and to advance said piston a fixed amount and whereby said return spring urges the drive bar over the sloped surface and against the flat surface of an adjacent pin when said actuating lever is released.

* * * * *